US006303004B1

(12) United States Patent
Ruf et al.

(10) Patent No.: US 6,303,004 B1
(45) Date of Patent: Oct. 16, 2001

(54) STOCK INLET

(75) Inventors: Wolfgang Ruf, Herbrechtingen (DE); Walter Holzer, Hofstetten (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/629,144

(22) Filed: Jul. 31, 2000

(30) Foreign Application Priority Data

Aug. 2, 1999 (DE) ..... 199 36 330

(51) Int. Cl.[7] ..... D21F 1/06; D21F 1/00; D21F 11/00

(52) U.S. Cl. ..... 162/343; 162/336; 162/216

(58) Field of Search ..... 162/212, 213, 162/216, 258, 336, 339, 341, 343, 259

(56) References Cited

U.S. PATENT DOCUMENTS

| | | | | |
|---|---|---|---|---|
| 4,221,635 | * | 9/1980 | Kurtz et al. | 162/343 |
| 5,792,321 | | 8/1998 | Aidun | 162/216 |
| 5,804,037 | | 9/1998 | Meinecke et al. | 162/343 |
| 5,876,564 | * | 3/1999 | Aidun | 162/216 |
| 5,882,482 | * | 3/1999 | Sze et al. | 162/336 |
| 6,153,057 | | 11/2000 | Aidun | 162/343 |

FOREIGN PATENT DOCUMENTS

| | | | |
|---|---|---|---|
| 19902621 | 7/2000 | (DE) | D21F/1/02 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Stock inlet of a paper machine that includes at least one stock suspension supply, a diffusor block having a plurality of tubular elements, dividing elements which extend across a width of the machine, and a stock inlet aperture having a top wall and a bottom wall. The dividing elements are located between the top wall and the bottom wall, so that a plurality of suspension conduits are formed, which extend across the width of the machine. Further, the stock inlet aperture is positioned one of adjacent one wire and between two wires. The suspension conduits include a first region and a second region disposed downstream of the first region, with respect to a stock flow direction. The first region is formed by flat boundary surfaces which extend across the width of the machine and converge in the stock flow direction, and each of the dividing elements has a sharper convergence of surfaces in the second region than in the first region. The plurality of tubular elements are associated with a turbulence generating element to produce secondary turbulence currents in partial suspension flows conveyed through the plurality of tubular elements. In this way, the secondary turbulence currents overlap a primary current of each partial suspension flow, and all of the dividing elements have a contour and an arrangement so that the second region for each suspension conduit is of equal length and has an identical cross sectional course.

50 Claims, 10 Drawing Sheets

STOCK INLET

CROSS-REFERENCE TO RELATED APPLICATIONS

The present application claims priority under 35 U.S.C. § 119 of German Patent Application No. 199 36 330.7, filed on Aug. 2, 1999, the disclosure of which is expressly incorporated by reference herein in its entirety.

BACKGROUND OF THE INVENTION

1. Field of the Invention

The invention relates to a stock inlet, in particular a multi-layer stock inlet, of a paper machine having at least one stock suspension supply, a diffusor block with a multitude of tubular elements, and a stock inlet aperture which has a number of suspension conduits running the width of the machine, which are formed between a top and bottom wall of the stock inlet aperture by at least two, preferably three, dividing elements which run the width of the machine and through which the stock suspension is conveyed onto a wire or between two wires, with the suspension conduits having a first region I and a second region II disposed downstream, with the first region I being constituted by flat boundary surfaces, which run the width of the machine and converge in the flow direction, and with each dividing element having a sharper convergence of its surfaces in the second region II than in the first region I.

2. Discussion of Background Information

A similar stock inlet is known, for example, from the Applicant's U.S. Pat. No. 5,599,428. Among other things, this document shows a stock inlet in FIG. 6, which has a stock inlet aperture with three internal dividing elements that separate the stock suspension of the individual layers of this stock inlet from one another. In the aperture outlet region, the dividing elements first have a widening and then a tapering (convergence) which should lead to there being only minimal mixing tendencies between the individual suspension layers that are brought together after the dividing elements.

A problem of these known stock inlets lies in the fact that the paper produced therewith has a striped structure, known as "tiger stripes," running the width of the machine, whose origin has not yet been definitively explained. These stripes, which are distinguished by alternating areas of higher and lower luster and extend in the machine direction, are particularly undesirable in high-quality papers and should be prevented to the greatest extent possible.

The Applicant's as yet unpublished DE 199 02 621.1 describes a stock inlet with lamellas to counteract tiger stripes. Lamellas of this kind also have a particularly positive effect on the jet quality.

U.S. Pat. No. 5,876,564 discloses building up angular momentum in the turbulence generator in order to increase the lateral strength and to keep the L/C ratio as low as possible, which is of particular interest for gap formers. A disadvantage of such an angular momentum generator, however, is the low jet quality and poor formation.

SUMMARY OF THE INVENTION

The object of the invention is to produce a stock inlet of the type mentioned at the outset in which both the highest possible strength as well as the greatest possible jet stability and best possible formation are simultaneously assured. Furthermore, the striped structure (tiger stripes) in the paper should be prevented or at least mitigated.

This object is attained according to the invention in that the tubular elements of the diffusor block are associated with a turbulence generating element in order to produce secondary turbulence currents in the partial suspension flows conveyed through these tubular elements, which turbulence currents overlap the primary current of these partial suspension flows, and in that all of the dividing elements of the stock inlet aperture have a contour and disposition which produce a second region II of equal length with an identical cross sectional course for each suspension conduit.

The term cross sectional course is understood to mean the change and absolute magnitude of the free area that is flowed through with regard to a position in the operational direction of the machine, with the variation of flow directions not being initially taken into consideration.

A high strength as well as a high jet stability and favorable formation are achieved simultaneously as a result of this embodiment. The disadvantages previously associated with angular momentum generators are consequently eliminated. Moreover, the striped structure (tiger stripes) in the paper are prevented or at least mitigated.

In particular, the turbulence generating element can be embodied in the manner described in U. S. Pat. No. 5,876,564. The use of these turbulence generating elements and the corresponding process for mixing the partial suspension flows can also be provided in the manner described in U.S. Pat. No. 5,876,564. To this end, the disclosure of this U.S. Pat. No. 5,876,564 is also included in its entirety in the disclosure of the current application.

In a suitable embodiment of the stock inlet according to the invention, the rotating motion of a each secondary turbulence current is generally oriented around the longitudinal axis of the respective tubular element.

It is also particularly advantageous for each secondary turbulence current to be generated so that a generally helical total flow is produced in the respective tubular element.

For example, the turbulence generation can be produced by means of a corresponding geometry and/or property of the inner surface of each tubular element or of each tubular insert.

In a preferred practical embodiment, the turbulence generating element includes at least one insert and/or yoke that is associated with each tubular element 18 and by means of which the respective partial suspension flow can be correspondingly influenced in order to generate the secondary turbulence current.

It is advantageous if at least one yoke or insert is designed for a pressure-induced influence of the applicable partial suspension flow and preferably includes at least one pressure impulse generating element. In this connection, each tubular element or tubular insert can be associated with, for example, at least two and preferably two to twelve pressure impulse generating elements.

In a suitable practical embodiment, at least one pressure impulse generating element is provided which is constituted by an acoustic element.

In certain instances, it can also be advantageous for at least one pressure impulse generating element to be provided that is constituted by an electromagnetic element.

In a suitable practical embodiment, at least one tubular element or at least one tubular insert is provided, which has an inlet provided as a flat section for receiving the stock suspension from a distributor and an outlet provided as an elongated section that feeds into the stock inlet aperture.

It is also advantageous if at least one tubular insert is provided which can be inserted into the diffusor block in order to receive stock suspension from a distributor.

In a preferred practical embodiment of the stock inlet according to the invention, at least one insert is provided which is constituted by a body disposed inside a respective tubular element, which body has at least two blades and, in order to generate turbulence, can be correspondingly acted on by at least one, preferably at least three magnet rings encompassing the tubular element and spaced apart from one another in the longitudinal direction of the tubular element.

The body can have two to twelve blades, for example.

In a suitable practical embodiment, the body is provided with external blades.

Fundamentally, however, an embodiment is also conceivable in which a preferably annular body is provided with internal blades.

According to the invention, the cross section of the suspension conduits can increase or decrease in the second region. It is also possible for there to be a uniform cross section in region II.

It is advantageous for the second region II to directly follow the first region I viewed in the flow direction.

It is also advantageous for the dividing elements to have a tapering in the end region, with the degree of convergence of the surfaces of the tapering ends of all of the dividing elements preferably being equal so that a flow is produced which is as turbulence-free as possible. In this connection, it is also advantageous to embody the tapering of the dividing elements in the second region II using flat surfaces.

The embodiment of the stock inlet is particularly advantageous if the degree of the divergence or convergence of all of the suspension conduits is of the same magnitude in the second region II. This means that all of the suspension conduits in the second region II have the same opening angle.

The opening angle of the suspension conduits in the second region II should lie between about 20° of convergence and about 120° of divergence, with a range between about 5° of convergence and about 7° of divergence being considered preferable.

Another advantageous embodiment of the stock inlet according to the invention provides for the course of the top wall and/or the bottom wall, at least in the second region II of the suspension conduit, with regard to the surface(s) in contact with the suspension, is/are embodied in mirror image fashion in relation to the course of the surface of the neighboring dividing element. This should achieve a further improvement with regard to the uniform embodiment of the outer suspension conduits in relation to the inner suspension conduits.

In order to assure that the stock suspension flow emerges from the stock inlet aperture as uniformly as possible, in a particularly advantageous embodiment of the stock inlet according to the invention, it is also provided for the downstream ends of the dividing elements to be disposed on an arc. Preferably, the radius center point M of the arc lies on the center line of the suspension jet produced.

Another preferred embodiment provides for the radius center point M of the arc to lie on the angle bisector of the suspension-contacted surfaces of the top and bottom wall in the second region II of the stock inlet aperture.

With regard to the disposition of the dividing elements in a stock inlet with a turbulence generator constituted by a multitude of diffusor tubes disposed in rows running the width of the machine, it is preferable to have the dividing elements begin between the rows of diffusor tubes, An advantageous length of the second region II of the stock suspension conduits is from 0 to about 4 dm, preferably approximately 0.5 to 2 dm. In addition, the preferred stock inlet has three dividing elements and four suspension conduits.

With regard to the dimension of the dividing elements, dividing elements are preferred whose greatest and smallest thickness lies in the range from a maximum of about 5 cm to a minimum of about 0.5 mm, preferably a maximum of about 1 cm to a minimum of about 3 mm.

In the embodiment of the stock inlet in the aperture region, it is also particularly advantageous for the suspension conduits to be embodied as congruent, at least in the second region II. That is, in each individual suspension conduit, including the two outer suspension conduits, the respective suspension is conveyed through absolutely identical cross sections, wherein in this instance, not only is the change of the cross sections the same in all of the suspension conduits, but also the individual curvatures of the conduits are embodied as identical or mirror-image identical. As a result, the stock suspension undergoes an absolutely identical treatment in all of the conduits, even with regard to the alignment of the velocity vectors, which particularly encourages the prevention of the striped structure of the paper.

Other advantageous embodiments of the stock inlet are comprised in that the angle bisectors of all of the suspension conduits in the second region II intersect at an intersection point A, the angle bisectors of all of the taperings of all of the dividing elements also intersect an intersection point B and, in a particularly advantageous manner, the intersection points A and B also coincide.

In addition, it is advantageous if the intersection points A and B are disposed on a line with the radius center point M of the arc of the ends of the dividing element. There is also the advantageous possibility of allowing the intersection points A and B to coincide with the radius center point M of the arc of the ends of the dividing element.

Consequently, the invention is also essentially based on the concept of assuring that before the ejection of the stock suspension from the stock inlet aperture, there is a last region in the stock inlet in which the stock suspension is treated in the same way simultaneously in all of the individual layers, i.e., the suspension conduits, and that the individual suspension flows of the suspension conduits meet at a moment in which all of the individual suspension layers have the most uniform possible current flow state and the most uniform possible prior flow states over the greatest possible period of time. The flow state of the suspension flow mainly involves the velocity, the acceleration, possibly the turbulence, and possibly the entire vector field of the flow velocities.

It is understood that the features of the invention mentioned above and explained in more detail below can be used not only in the combinations indicated, but also in other combinations or by themselves without departing from the scope of the invention.

Other features and advantages of the invention ensue from the dependent claims and the subsequent description of exemplary embodiments with reference to the drawings.

The present invention is directed to a stock inlet of a paper machine. The stock inlet includes at least one stock suspension supply, a diffusor block having a plurality of tubular elements, dividing elements which extend across a width of the machine, and a stock inlet aperture having a top wall and a bottom wall. The dividing elements are located between the top wall and the bottom wall, so that a plurality of suspension conduits are formed, which extend across the width of the machine. Further, the stock inlet aperture is positioned one of adjacent one wire and between two wires. The suspension conduits include a first region and a second region disposed downstream of the first region, with respect to a stock flow direction. The first region is formed by flat boundary surfaces which extend across the width of the machine and converge in the stock flow direction, and each of the dividing elements has a sharper convergence of surfaces in the second region than in the first region. The plurality of tubular elements are associated with a turbulence generating element to produce secondary turbulence currents in partial suspension flows conveyed through the plurality of tubular elements. In this way, the secondary turbulence currents overlap a primary current of each partial suspension flow, and all of the dividing elements have a contour and an arrangement so that the second region for each suspension conduit is of equal length and has an identical cross sectional course.

In accordance with a feature of the invention, the stock inlet can be a multilayer stock inlet, and the dividing element can include at least two dividing elements. The at least two dividing elements may be three dividing elements.

According to another feature of the present invention, the rotating motion of each secondary turbulence current can generally be oriented around a longitudinal axis of a respective tubular element.

Further, the plurality of tubular elements can be structured to produce a generally helical total flow in each secondary turbulence current.

Moreover, turbulence generation can be produced by at least one of a corresponding geometry and a property of an inner surface of one of each the tubular element and tubular inserts.

In accordance with still another feature of the instant invention, the turbulence generating element may include at least one of at least one insert and a yoke associated with each tubular element. In this manner, the partial suspension flow can be correspondingly influenced in order to generate the secondary turbulence current. The at least one of the yoke and the at least one insert can be adapted for a pressure-induced influence on the partial suspension flow. Further, the at least one of the yoke and the at least one inlet may include at least one pressure impulse generating element. One of each tubular element and the at least one insert includes at least two pressure impulse generating elements. The one of each tubular element and the at least one insert can include between two and twelve pressure impulse elements.

According to a further feature of the invention, at least one pressure impulse generating element can be composed of an acoustic element. Additionally, or alternatively, at least one pressure impulse generating element can be composed of an electromagnetic element.

In accordance with a still further feature of the invention, one of at least one of the plurality of tubular elements and at least one tubular insert can include an inlet having a flat section adapted to receive the stock suspension from a distributor and an outlet having an elongated section that feeds into the stock inlet aperture.

According to still another feature of the present invention, at least one tubular insert that is insertable into the diffusor block can be adapted to receive the stock suspension from a distributor.

Further, at least one insert can include a body located inside a respective tubular element, and the body can have at least two blades and at least one magnet ring arranged to encompass the respective tubular element. The at least one magnet ring may act on the at least two blade, thereby generating a turbulence. The at least one magnet ring can include at least three magnet rings, and the at least magnet rings may be arranged spaced from each other in a longitudinal direction of the respective tubular element. The body can have between two and twelve external blades. Still further, the body may include external blades. The body can also include an annular body having internal blades.

According to another feature of the instant invention, the cross section of the suspension conduits can increase in the flow direction in the second region. Alternatively, or additionally, the cross section of the suspension conduits can decrease in the second region.

In accordance with still another feature of the invention, the cross section of the suspension conduits may remain substantially the same in the second region.

According to the invention, the second region can directly follow the first region.

In accordance with a still further feature of the invention, a tapering of the dividing elements in the second region can be formed by flat surfaces.

In accordance with the present invention, a degree of one of divergence and convergence of all of the suspension conduits can be of a substantially same magnitude in the second region.

Further, boundary surfaces of the suspension conduits, which extend across the width of the machine, can form an angle between about 20° of convergence and about 120° of divergence in an end region. Still further, boundary surfaces of the suspension conduits, which extend across the width of the machine, can form an angle between about 5° of convergence and about 7° of divergence in an end region.

According to still another feature of the present invention, with regard to surfaces in contact with the suspension in at least the second region, a course of at least one of the top wall and the bottom wall may be formed as to a course of an adjacent surface of a neighboring dividing element.

Moreover, downstream ends of the dividing elements, relative to a stock flow direction, can be arranged to form an arc. A radius center point M of the arc may lie on a center line of a suspension jet produced. Further, a radius center point M of the arc may lie on angle bisectors of the suspension-contacted surfaces of the top wall and the bottom wall in the second region.

According to a still further feature of the instant invention, a turbulence generator can have a plurality of diffusor tubes. The plurality of diffuisor tubes can be arranged in rows running across the width of the machine and the dividing elements may begin between the rows of the diffusor tubes.

In accordance with an aspect of the invention, the top wall and bottom wall can be equal in length.

Further, the second region can have a length between 0 and about 4 dm. Still further, the second region can have a length of between about 0. 5 and 2 dm.

In accordance with another aspect of the present invention, the dividing element can include three dividing elements arranged to form four suspension conduits.

The dividing elements may have a greatest and smallest thickness in a range from a maximum of about 5 cm to a minimum of about 0.5 mm. Further, the greatest and smallest thickness range for the dividing elements can be a maximum of about 1 cm to a minimum of about 3 mm.

According to still another aspect of the instant invention, at least in the second region, all of the suspension conduits can be substantially congruent.

In accordance with a further aspect of the present invention, angle bisectors of all of the suspension conduits in the second region may intersect at a same intersection point A. Further, the dividing elements can have tapering ends oriented toward the stock inlet aperture, and angle bisectors of all of the tapering ends may intersect at a same intersection point B. Still further, the same intersection points A and B coincide. Moreover, the tapering ends can be arranged to form an arc, and the same intersection points A and B may be collinearly arranged on a line with a radius center point M of the arc. Further still, the same intersection points A and B may coincide with the radius center point M.

According to still another feature of the invention, at least one of the top wall and the bottom wall can have a shutter which is adapted to influences a height of an outlet gap of the stock inlet aperture.

In accordance with still another aspect of the present invention, the top wall and the bottom wall can be different lengths, Further, the bottom wall can be longer than the top wall. Still further, a shutter can be attached to a shorter one of the top wall and the bottom wall.

According to yet another feature of the instant invention, the top wall and the bottom wall may be longer than the dividing elements.

Other exemplary embodiments an d advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
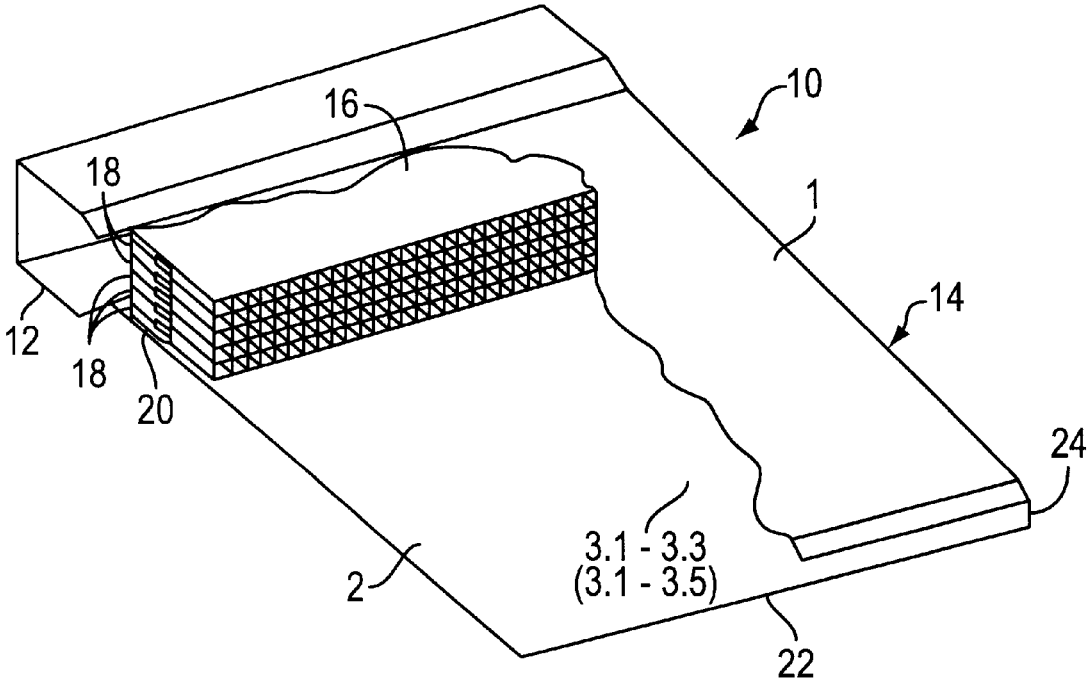
FIG. 1 is a schematic perspective representation of a stock inlet having a diffusor block with a turbulence generating element and having a stock inlet aperture with dividing elements (see FIGS. 14 to 18), wherein the dividing, elements have been omitted in order to better depict the diffuisor block.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice, In a purely schematic form, FIGS. 1 to 18 depict a stock inlet 10 whose diffusor block 16, which contains a number of tubular elements 18 or whose turbulence generator, which is provided with a turbulence generating element 20 (e.g., see FIG. 1) and whose stock inlet aperture 14 is provided with dividing elements 3.1 to 3.5 in a manner that is particularly shown in FIGS. 14 to 18. In FIG. 1, the dividing elements 3.1 to 3.5 have been omitted merely in order to better depict the diffusor block 16. Also, in this embodiment according to FIG. 1, corresponding dividing elements are provided as described in more detail in FIGS. 14 to 18.

As can be seen from FIG. 1, the stock suspension is supplied to the diffusor block 16 via a distributor 12, by means of which the suspension is correspondingly distributed across the width of the stock inlet. The aperture chamber of the stock inlet 14, which is defined by a top wall 1 and a bottom wall 2, feeds into an outlet gap 22 so that a flat outlet jet 24 is produced. The aperture chamber feeding into the outlet gap 22 is connected to the distributor 12 via the diffusor block 16.

The turbulence generating element 20 associated with the tubular elements 18 of the diffusor block 16 produce secondary turbulence currents in the partial suspension flows conveyed through the tubular elements 18 and these secondary turbulence currents overlap the primary current of these partial suspension flows, which generally runs in the operational direction of the machine. As a result, the rotating motion of each secondary turbulence current is preferably oriented generally around the longitudinal axis of each tubular element 18. In this connection, each secondary tubular current is particularly generated so that a generally helical total current is produced in each tubular element 18, which generally runs in the operational direction of the machine and has the overlapping secondary turbulence current.

Figure 2:
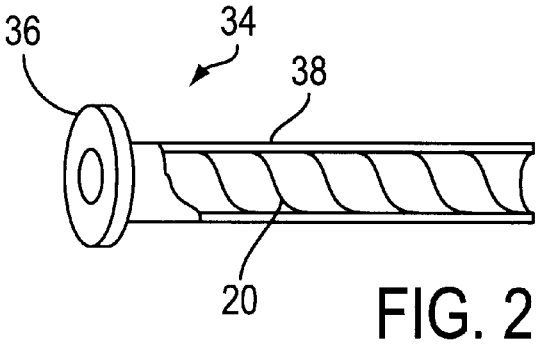
FIG. 2 is a schematic representation of an insert tube provided with a turbulence generating element.

The turbulence generation can be produced, for example, by means of a corresponding geometry and/or property of the inner surface of each tubular element 18 (e.g., see FIGS. 3 to 5) or of each tubular insert 34 (e.g., see FIG. 2).

FIG. 2 schematically depicts an insert tube 34 provided with a turbulence generating element of this kind. This insert tube 34 has an inlet provided as a flat section 36 for receiving the stock suspension from the distributor 12 and an outlet provided as an elongated section 38 that feeds into the stock inlet aperture 14. In the current instance, the turbulence generating element 20 includes a helical internal groove.

A tubular insert 34 of this kind can, for example, be inserted into pre-existing tubular elements 18 in order to generate the desired secondary turbulence current.

Figure 3:
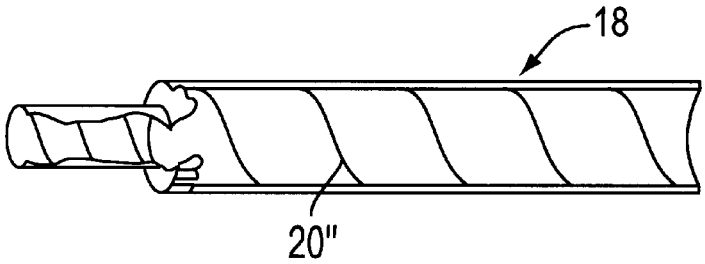
FIG. 3 is a schematic representation of a tubular element, which is provided with a turbulence generating element and belongs to a stepped diffusor block.

FIG. 3 schematically depicts a tubular element 18 of a stepped diffusor block, which is provided with the turbulence generating element 20. The turbulence generating element 20 includes a helical internal groove here as well. In this connection, the pitch of this groove can change in the axial direction, as indicated at the points 20', 20", and 20'". As can be seen from FIG. 3, this pitch particularly changes between the points 20" and 20'".

Figure 4:
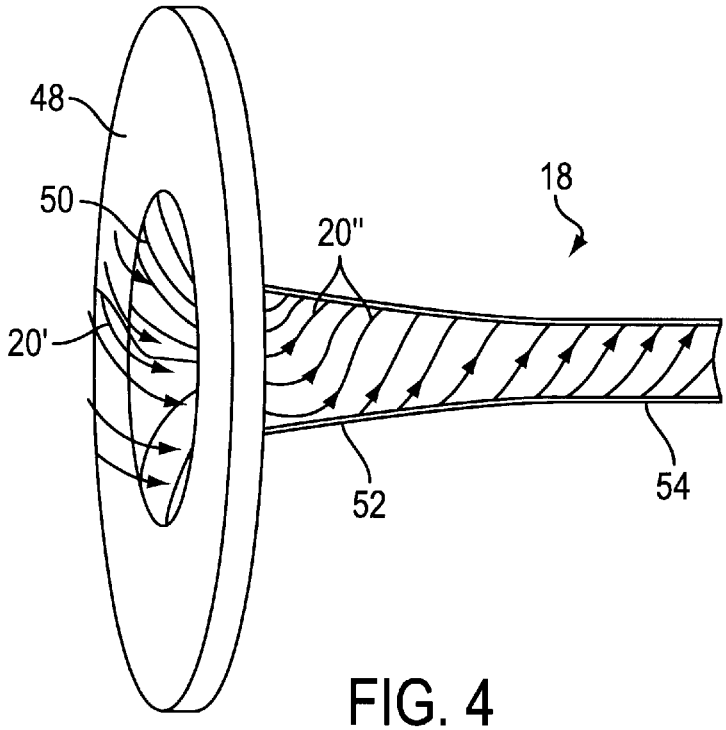
FIG. 4 is a schematic representation of another embodiment of a tubular element provided with a turbulence generating element.
Figure 5:
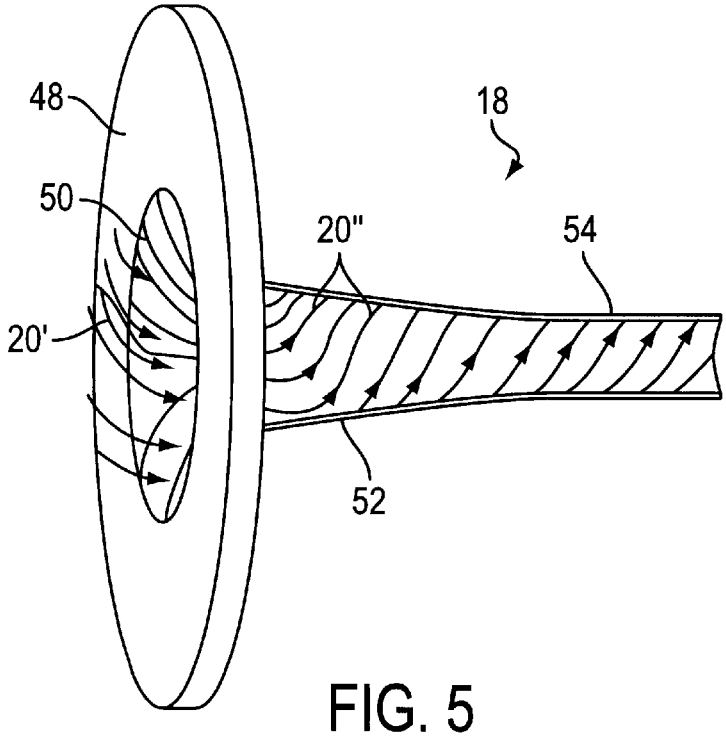
FIG. 5 is a schematic representation of another embodiment of a tubular element provided with a turbulence generating element.

FIGS. 4 and 5 also each show a tubular element 18 that is provided with a turbulence generating element 20. Both embodiments also each have an inlet provided as a flat section 48 for receiving the stock suspension from the distributor 12 (see FIG. 1) and an outlet provided as an elongated section 52, 54 which feeds into the stock inlet aperture 14. The turbulence generating element in this instance includes, for example, inclined ribs or grooves 20' provided on the flat sections 48 as well as helical internal grooves 20" in the elongated sections 52, 54 and in curved transition regions 50 provided between these elongated sections and the flat sections 48. In the current instance, the elongated sections 52, 54 each have a converging section 52 that adjoins the respective flat section 48. Whereas in the embodiment according to FIG. 4, the inclined groove or rib 20' is provided in both the flat section 48 and the curved transition region 50, in the embodiment shown in FIG. 5, this inclined groove 20' is only provided in the flat section 48.

Figure 6:
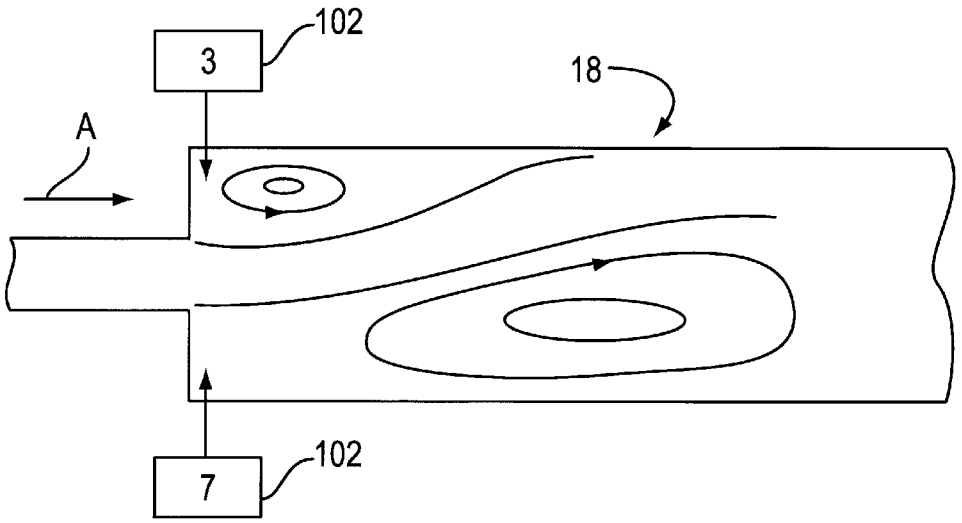
FIG. 6 is a schematic cross sectional view of a tubular element with associated pressure impulse generating elements.
Figure 7:
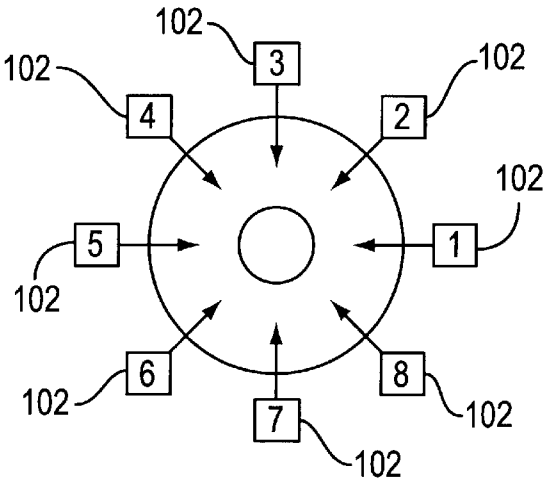
FIG. 7 is a view of the tubular element according to FIG. 6 in the direction of the arrow A.
Figure 8:
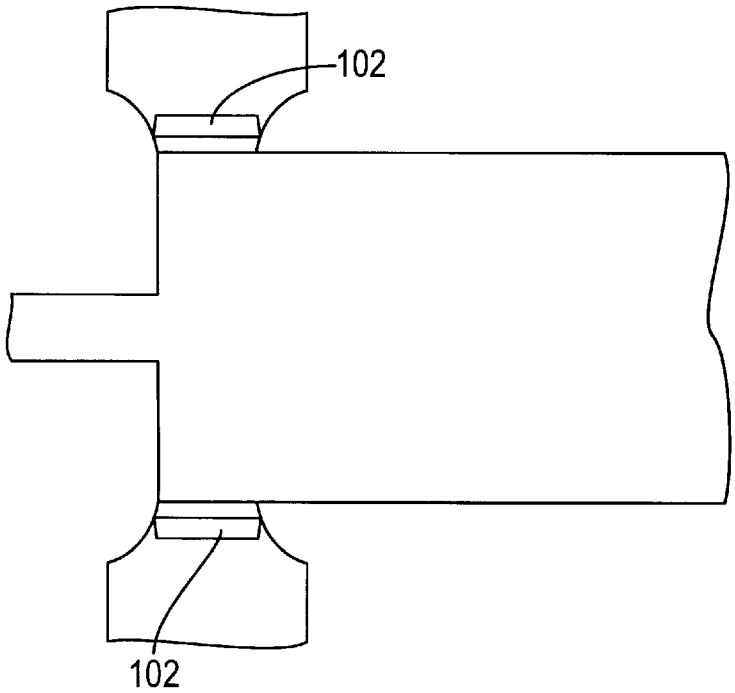
FIG. 8 is a schematic cross sectional view of a tubular element with associated pressure impulse generating elements.
Figure 9:
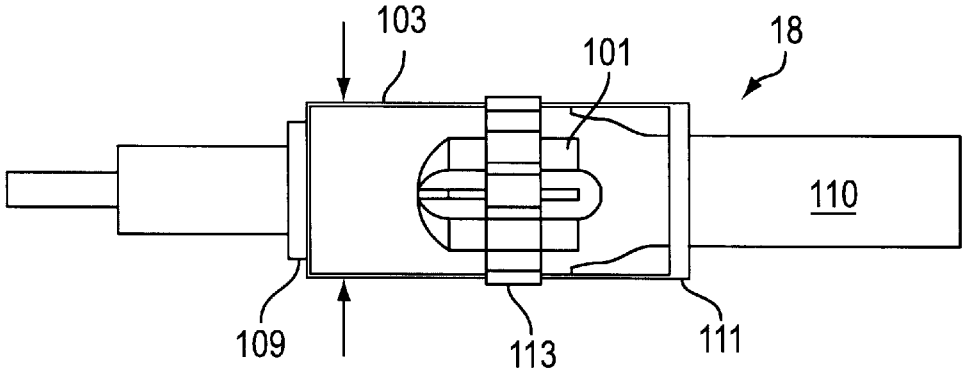
FIG. 9 is a schematic cross sectional view of a tubular element with a magnetically actuatable body that is used to generate turbulence and is provided with external blades.
Figure 10:
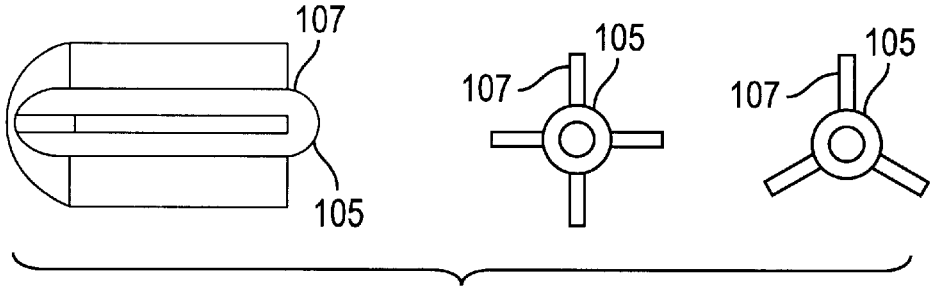
FIG. 10 is a schematic side and front view of the body provided with external blades according to FIG. 9.

FIG. 6 shows a purely schematic cross sectional view of a tubular element 18 with associated pressure impulse generating elements 102 in the vicinity of a step provided between a smaller diameter section and a larger diameter section. As can be seen from FIG. 6, the pressure impulse generating elements 102 are provided at the beginning of the larger diameter section. According to FIG. 7, in the current instance, eight of these pressure impulse generating elements 102 are distributed over the circumference of the tubular element 18. According to FIG. 8, the pressure impulse generating elements 102 can end flush with the inner wall of the tubular element 18.

In the current instance, the turbulence generating element 20 consequently includes inserts and/or yokes constituted by the pressure impulse generating elements 102, by means of which the respective partial suspension flows can be correspondingly influenced in order to generate the secondary turbulence currents.

For example, the pressure impulse generating elements 102 can be acoustic and/or electromagnetic elements As can be inferred in particular from FIGS. 9 to 12, the turbulence generating element 20 can also include at least one insert 102 constituted by a body 105, which is disposed inside the respective tubular element 18 and has at least two blades 107. Thus, according to FIGS. 9 and 10, for example, a magnetically actuatable body 105 used to generate turbulence, which is provided, for example, with three or four external blades 107, is inserted into the tubular element 18. In the current instance, this body 105 provided with blades 107 can be correspondingly acted upon by means of three magnetic rings 109, 111, 113, which encompass the tubular element 18 and are spaced apart from one another in the longitudinal direction of the tubular element 18.

Figure 11:
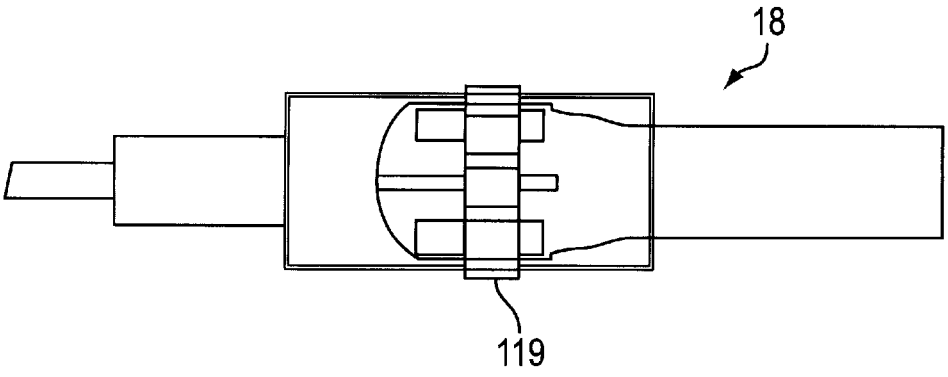
FIG. 11 is a schematic cross sectional view of a tubular element with a magnetically actuatable, annular body that is used to generate turbulence and is provided with internal blades.
Figure 12:
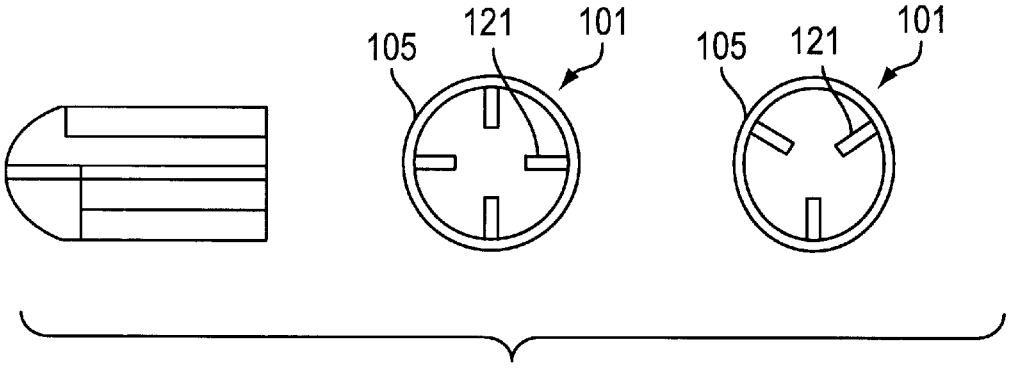
FIG. 12 is a schematic side and front view of the body provided with internal blades according to FIG. 11.

In contrast to this, FIGS. 11 and 12 schematically depict a tubular element 18 into which a magnetically actuatable annular body 105 is inserted, which is used to generate turbulence and is provided with three or four internal blades 121.

Figure 13:
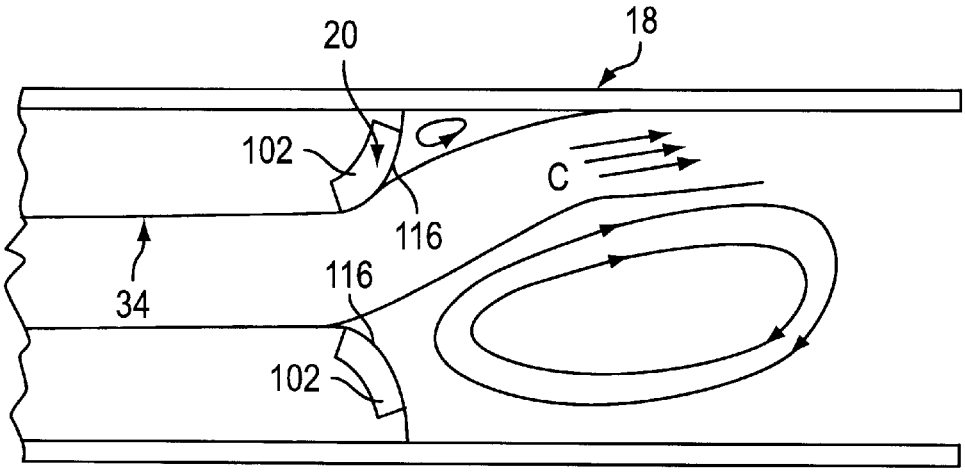
FIG. 13 is a schematic cross sectional view of another embodiment of a pressure impulse generating element in the form of a ring.

In a purely schematic form, FIG. 13 shows another embodiment of a pressure impulse generating element 102 which, in the current instance, is embodied in the form of a ring. As can be seen in FIG. 13, this annular pressure impulse generating element 102 is provided at the end of an insert tube 34 inserted into a tubular element 18, by means of which a left section with a smaller diameter and a right section with a larger diameter are formed, with the annular pressure impulse generating element 102 being provided in the vicinity of the circularly curved transition 116. The flow direction is indicated by the letter C.

Otherwise, the turbulence generating element can, in particular, be embodied and used in the manner described in U.S. Pat. No. 5,876,564.

Figure 14:
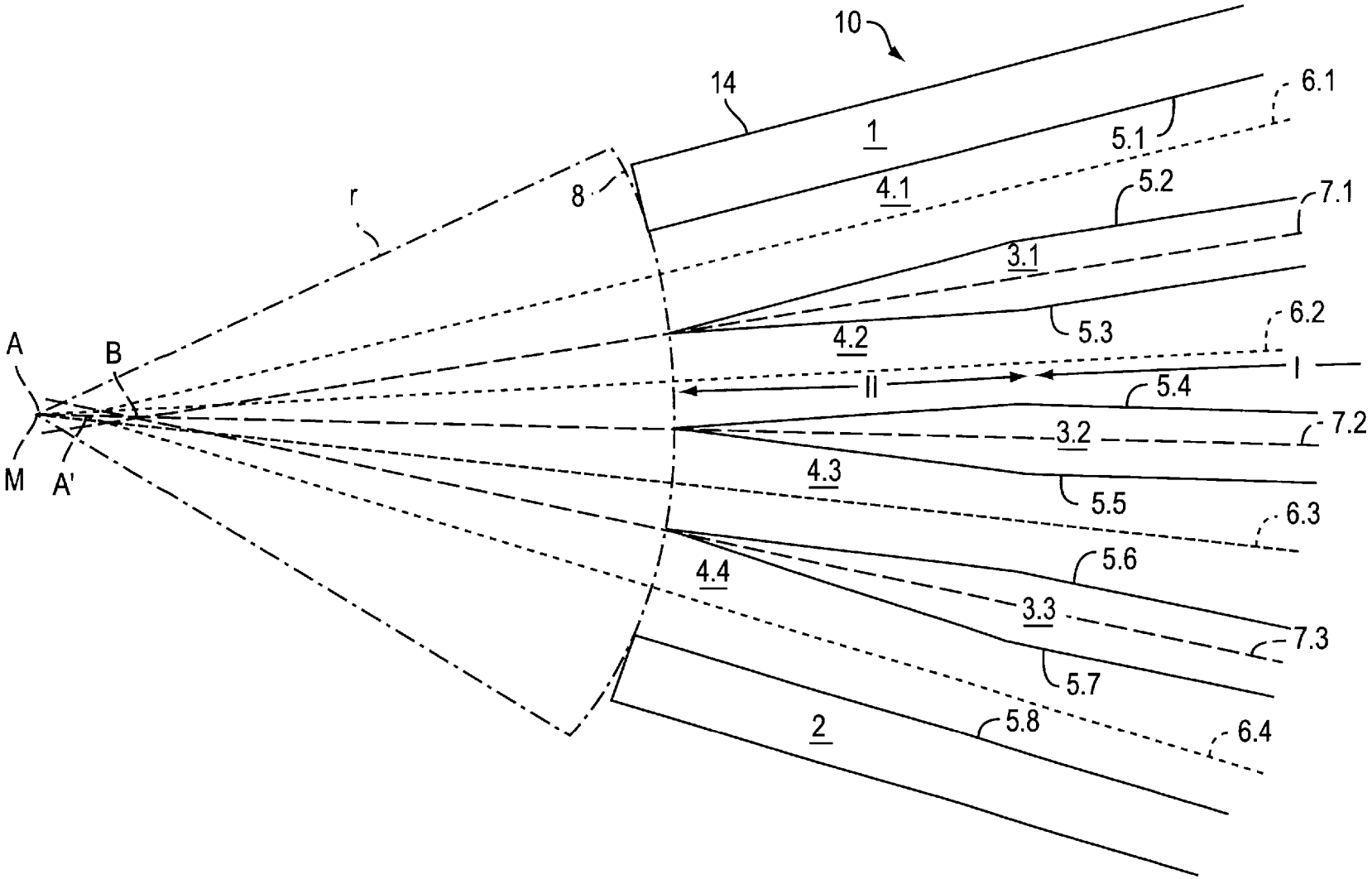
FIG. 14 shows a symmetrical stock inlet aperture of the stock inlet with a flat top and bottom wall.

FIG. 14 shows a longitudinal section of the aperture region of the stock inlet 10 in a schematic representation. The stock inlet aperture is constituted by a top wall 1 and a bottom wall 2, with three dividing elements 3.1 to 3.3 disposed therebetween. The suspension-contacting surfaces 5.1 to 5.8 of both the dividing elements 3.1 to 3.3 and of the top and bottom wall 1, 2 constitute four suspension conduits 4.1 to 4.4 running the width of the machine, which have a first region I upstream in which the suspension-contacting surfaces 5.1 to 5.8 linearly converge and then have a second region II in which the surfaces 5.1 to 5.8 diverge. In an exemplary embodiment, the degree of divergence or convergence for all of suspension conduits 4.1 to 4.4 can be of substantially the same magnitude. In another embodiment, boundary or suspension-contacting surfaces 5.1 to 5.8 of suspension conduits 4.1 to 4.4, which extend across the width of the machine, can form an angle between about 20° of convergence and about 120° of divergence. Still further, boundary surfaces 5.1 to 5.8 of the suspension conduits 4.1 to 4.4, which extend across the width of the machine, can form an angle between about 5° of convergence and about 7° of divergence. Correspondingly, the cross sections of the suspension conduits 4.1 to 4.4 increase downstream in the second region II. In the second region II, the surfaces 5.2 and 5.3, 5.4 and 5.5, 5.6 and 5.7 of the tapering dividing elements constitute angle bisectors 6.1 to 6.4, which are depicted with dotted lines. Furthermore, the angle bisectors 7.1 to 7.3 of the converging surfaces of the dividing elements 3.1 to 3.3 are depicted with dashed lines. The angle bisectors 6.2, 6.3 of the two conduits 4.2, 4.3, which are formed exclusively by the dividing elements 3.1 to 3.3, meet at a point A which, in this instance, coincides with the radius center point M of the arc 8, which center point is disposed downstream of the arc on which the ends of the dividing elements are disposed. Furthermore, the angle bisectors 7.1 to 7.3 of the taperings of the dividing elements meet at a point B and the angle bisectors of the two outer suspension conduits 6.1, 6.4 meet at a point A'. All of the points A, A', M, and B are disposed on a common line.

By means of this embodiment and the correct choice of the tapering of the dividing elements 3.1 to 3.3, it can be assured that the cross sectional changes and the progression of the absolute values of the cross sections of all of the suspension conduits are equal.

Figure 15:
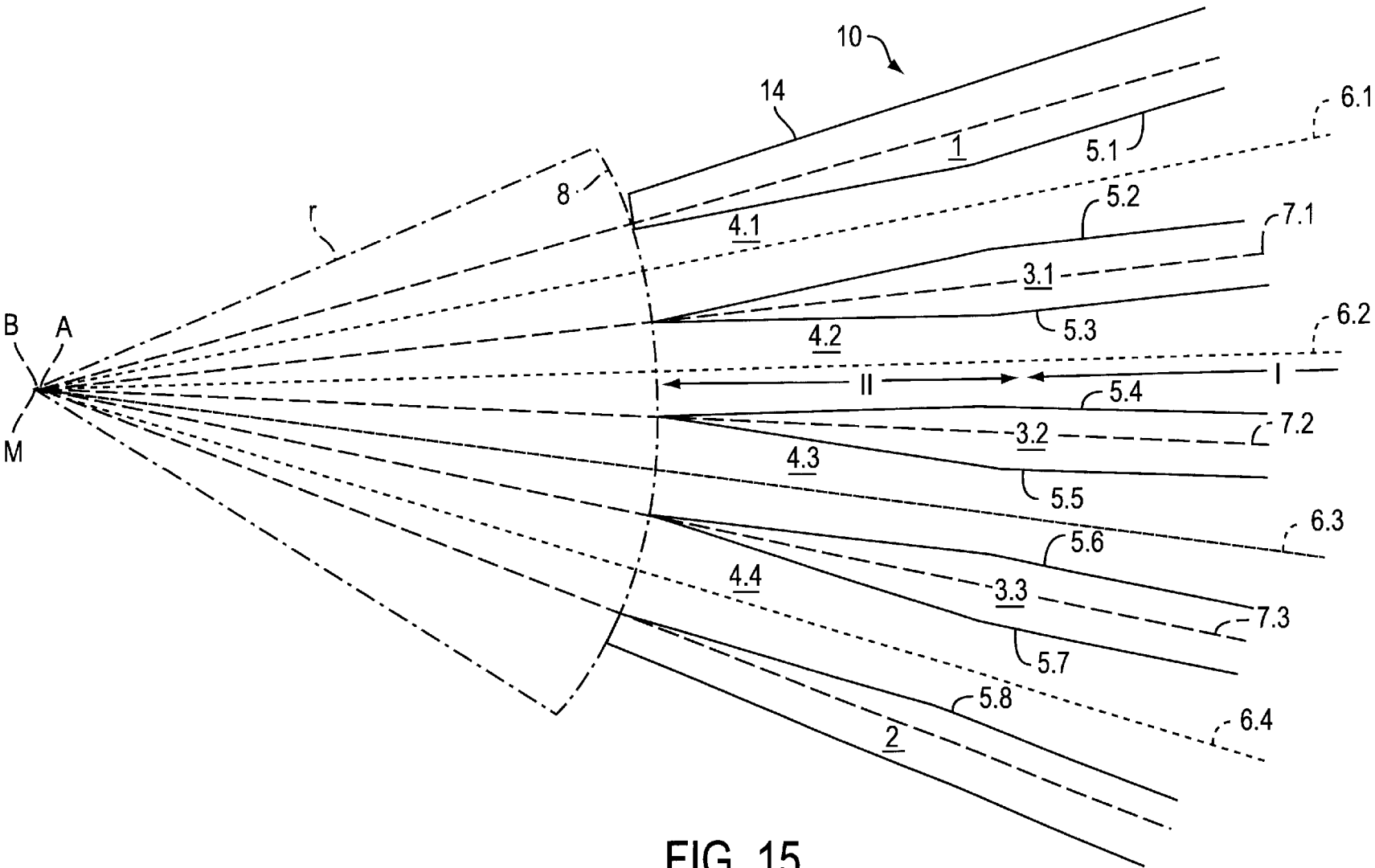
FIG. 15 shows a symmetrical stock inlet aperture of the stock inlet with a bend in the suspension-contacted surfaces of the top and bottom wall.

FIG. 15 schematically depicts a longitudinal section of an improved embodiment of the stock inlet aperture of the stock inlet according to the invention. This figure also shows the aperture region of the stock inlet 10 with the top wall 1 and the bottom wall 2 and three internal dividing elements 3.1 to 3.3.

In this embodiment, the stock suspension conduits 4.1 to 4.4 are embodied in such a way that all of the second regions II of the suspension conduits have an angle bisector 6.1 to 6.4, all of which meet at a common point A, with the angle bisectors 7.1 to 7.3 of the dividing elements 3.1 to 3.3 also meeting at a point B. Furthermore, the ends of the dividing lamellas are disposed on an arc with a radius center point M. The exceptional feature of the subject of FIG. 15 is that the intersection points A, B and the radius center point M of the arc all coincide in one point.

This particular symmetrical form of the stock inlet aperture is achieved in that the opening angle of the second region of the suspension conduits 4.1 to 4.4 is also achieved in the two outer suspension conduits 4.1, 4.4 in that the suspension-contacting surfaces 5.1. 5.8 of the top wall 1 and bottom wall 2 are embodied as absolutely symmetrical to the surface 5.2 or 5.7 of the respectively opposing dividing element 3.1 or 3.3 so that, in the transition from the first region to the second, these also have a bend in the surface and this bend runs the width of the machine.

This achieves the fact that all of the suspension conduits 4.1 to 4.4 are congruent and also the vector fields of the flow velocities in the suspension conduits are identical.

Figure 16:
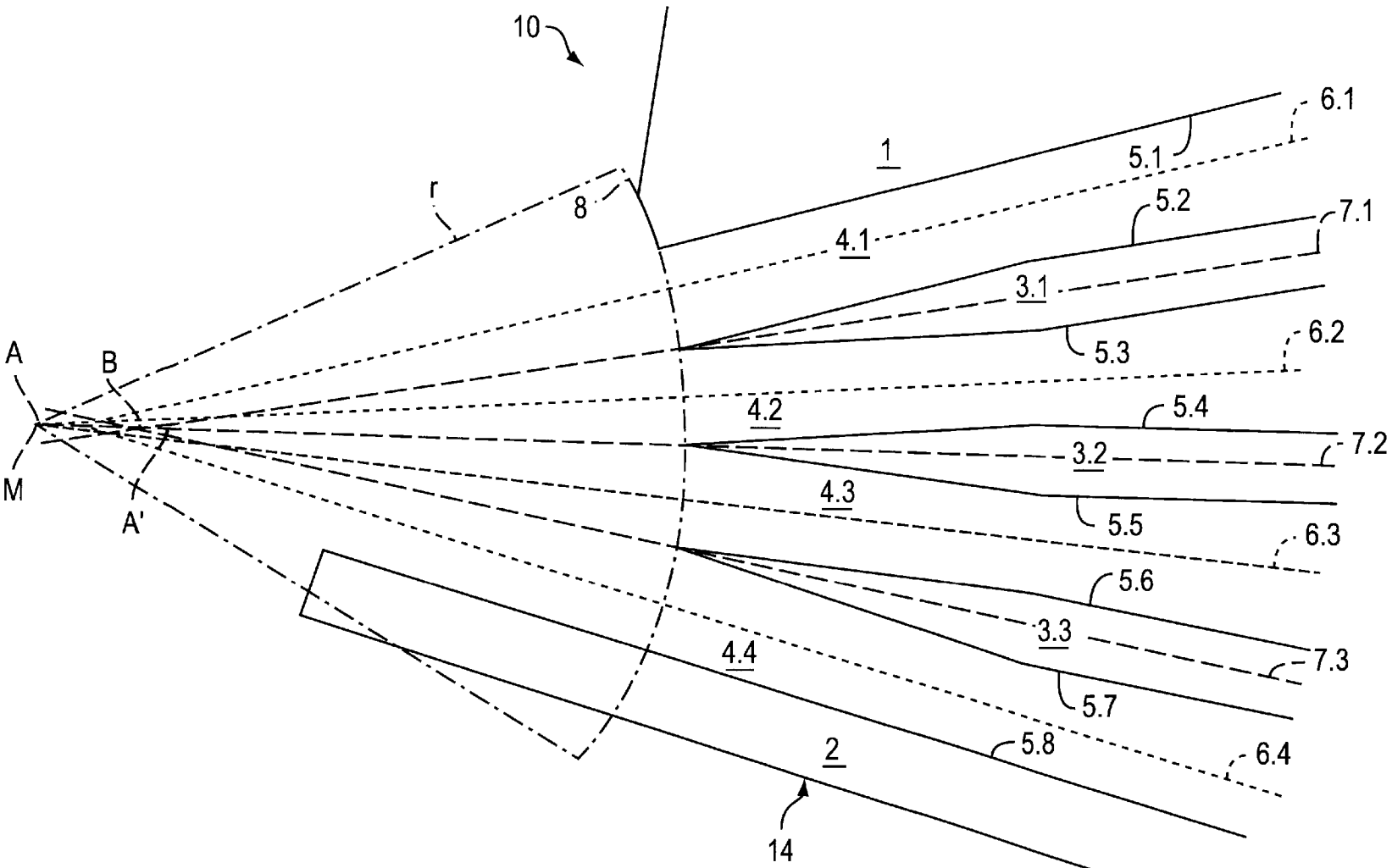
FIG. 16 shows an asymmetrical stock inlet aperture of the stock inlet with a flat top and bottom wall.

Another variant of the stock inlet is shown in FIG. 16. Whereas the stock inlets in FIGS. 14 and 15 are essentially suited for twin-wire machines, in particular gap-formers due to their symmetrical design. FIG. 16 shows a stock inlet for a fourdrinier wires whose exceptional feature in comparison to FIG. 14 is that the bottom wall 2 extends slightly past the arc. Otherwise, the stock inlet in FIG. 16 corresponds to the depiction in FIG. 14.

Figure 17:
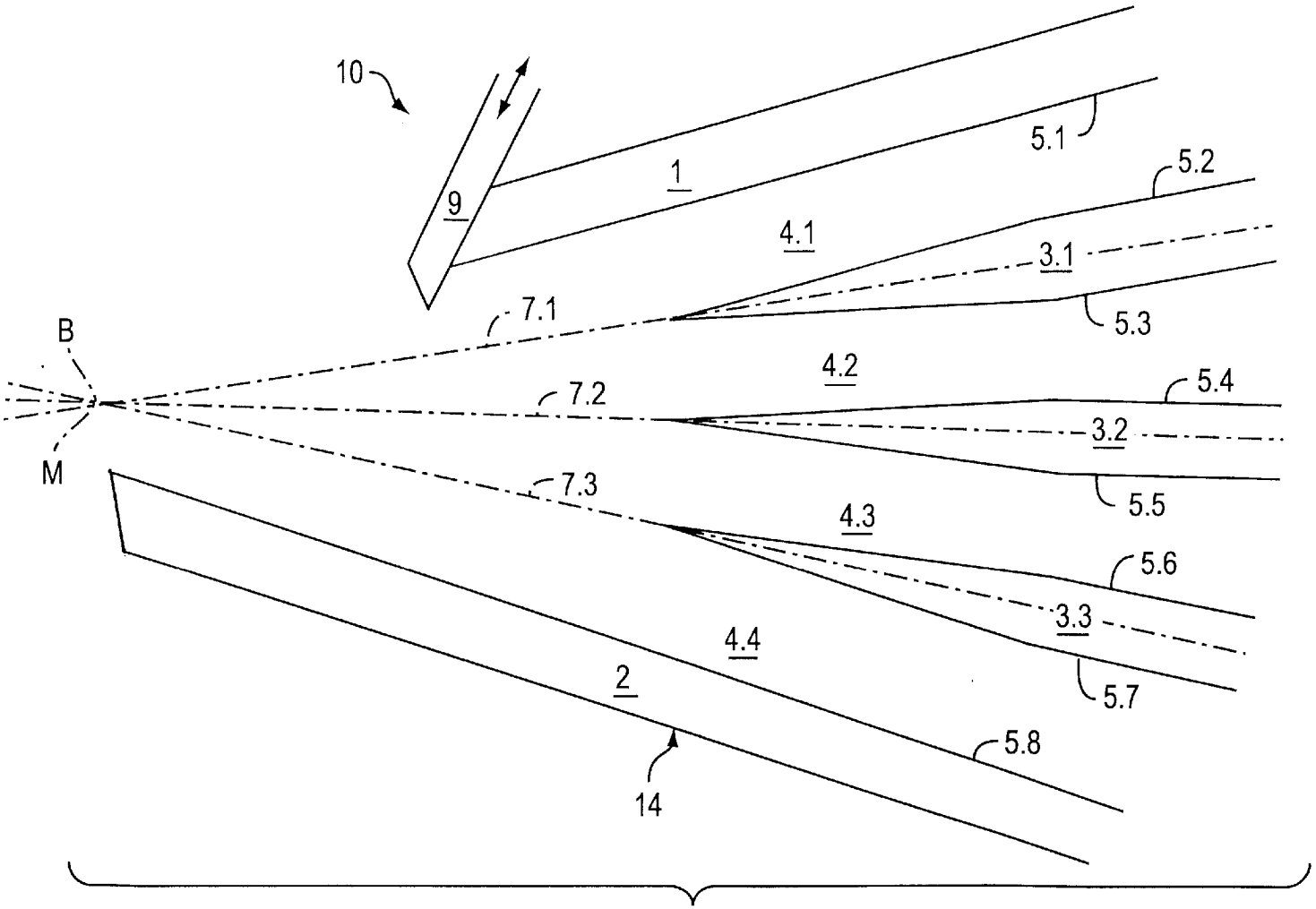
FIG. 17 shows a stock inlet aperture of a fourdrinier wire stock inlet or single-layer gap-former stock inlet.

FIG. 17 shows the variation of the stock inlet according to FIG. 16. In this instance, the stock inlet has an additional shutter 9 on the top wall 1 and this shutter 9 can be used to adjust the free aperture outlet gap in a known manner.

Figure 18:
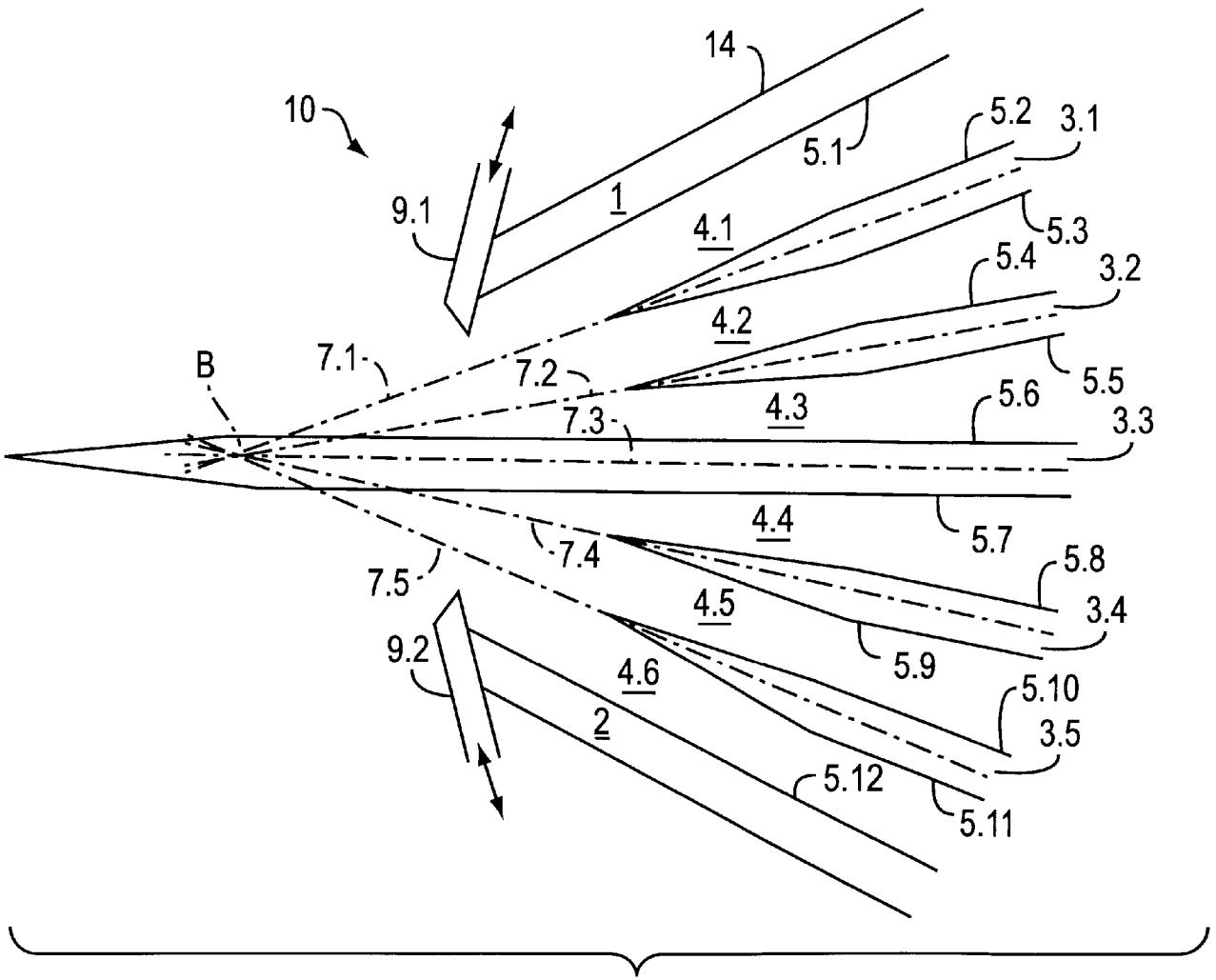
FIG. 18 shows a stock inlet aperture of a multi-layer stock inlet.

FIG. 18 shows another variation of a stock inlet according to the invention. In this instance, it is a multi-layer stock inlet in which three suspension conduits 4.1 to 4.3 are shown in the upper half of the stock inlet and three other suspension conduits 4.4 to 4.6 are shown in the lower half of the stock inlet. The two halves of the stock inlet are separated by a centrally disposed dividing element 3.3 whose length protrudes beyond the aperture outlet gap, which is formed by the two shutters 9.1 and 9.2. In this instance, the angle bisectors of the taperings of the dividing elements 7.1 to 7.5 intersect at the intersection point B which, in this embodiment of the stock inlet, is disposed on the center line of the central dividing element 3.3. Both shutters 9.1 and 9.2, which are attached to the top wall 1 and the bottom wall 2, respectively, are embodied as adjustable so that the aperture outlet gap of the upper or lower half of the stock inlet can be adjusted by this means.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

| | |
|---|---|
| 1 | first wall, top wall |
| 2 | second wall, bottom wall |
| 3.1–3.5 | dividing elements |
| 4.1–4.6 | suspension conduits |
| 5.1–5.12 | boundary surfaces |
| 6.1–6.4 | angle bisectors of the suspension conduits in the second region |
| 7.1–7.5 | angle bisectors of the taperings of the dividing elements |
| 9, 9.1, 9.2 | shutters |
| 8 | arc |
| 10 | stock inlet |
| 12 | distributor |
| 14 | stock inlet aperture |
| 16 | diffusor block |
| 18 | tubular shutter |
| 20 | turbulence generating element |
| 22 | outlet gap |
| 24 | flat outlet jet |
| 34 | tubular insert |
| 36 | flat section |
| 38 | elongated section |
| 48 | flat section |
| 50 | transition region |
| 52, 54 | elongated section |
| 101 | insert |
| 102 | pressure impulse generating element |
| 105 | body |
| 7 | external blade |
| 9 | magnet ring |
| 111 | magnet ring |
| 113 | magnet ring |
| 116 | transition |
| 121 | internal blade |
| A | intersection point of the angle bisectors |
| B | intersection point of the angle bisectors |
| C | flow direction |

What is claimed is:

1. A stock inlet of a paper machine comprising:

at least one stock suspension supply;

a diffusor block having a plurality of tubular elements;

dividing elements which extend across a width of the machine;

a stock inlet aperture having a top wall and a bottom wall, and said dividing elements being located between said top wall and said bottom wall, whereby a plurality of suspension conduits are formed, which extend across the width of the machine, and wherein said stock inlet aperture is positioned one of adjacent one wire and between two wires;

said suspension conduits include a first region and a second region disposed downstream of said first region, with respect to a stock flow direction, wherein said first region is formed by flat boundary surfaces which extend across the width of the machine and converge in the stock flow direction, and wherein each of said dividing elements has a sharper convergence of surfaces in said second region than in said first region;

said plurality of tubular elements being associated with a turbulence generating element to produce secondary turbulence currents in partial suspension flows conveyed through said plurality of tubular elements, wherein the secondary turbulence currents overlap a primary current of each partial suspension flows, and wherein all of said dividing elements have a contour and an arrangement so that said second region for each said suspension conduit is of equal length and has an identical cross sectional course.

2. The stock inlet in accordance with claim 1, wherein said stock inlet is a multilayer stock inlet, and wherein said dividing element comprises at least two dividing elements.

3. The stock inlet in accordance with claim 2, wherein said at least two dividing elements are three dividing elements.

4. The stock inlet in accordance with claim 1, wherein the rotating motion of each secondary turbulence current is generally oriented around a longitudinal axis of a respective tubular element.

5. The stock inlet in accordance with claim 1, wherein said plurality of tubular elements are structured to produce a generally helical total flow in each secondary turbulence current.

6. The stock inlet in accordance with claim 1, wherein turbulence generation is produced by at least one of a corresponding geometry and a property of an inner surface of one of each said tubular element and tubular inserts.

7. The stock inlet in accordance with claim 1, wherein said turbulence generating element includes at least one of at least one insert and a yoke associated with each tubular element, whereby the partial suspension flow can be correspondingly influenced in order to generate the secondary turbulence current.

8. The stock inlet in accordance with claim 7, wherein said at least one of said yoke and said at least one insert is adapted for a pressure-induced influence on the partial suspension flow.

9. The stock inlet in accordance with claim 8, wherein said at least one of said yoke and said at least one inlet includes at least one pressure impulse generating element.

10. The stock inlet in accordance with claim 7, wherein one of each said tubular element and said at least one insert includes at least two pressure impulse generating elements.

11. The stock inlet in accordance with claim 10, wherein said one of each said tubular element and said at least one insert includes between two and twelve pressure impulse elements.

12. The stock inlet in accordance with claim 1, further comprising at least one pressure impulse generating element composed of an acoustic element.

13. The stock inlet in accordance with claim 1, further comprising at least one pressure impulse generating element composed of an electromagnetic element.

14. The stock inlet in accordance with claim 1, wherein one of at least one of said plurality of tubular elements and at least one tubular insert include an inlet having a flat section adapted to receive the stock suspension from a distributor and an outlet having an elongated section that feeds into said stock inlet aperture.

15. The stock inlet in accordance with claim 1, further comprising at least one tubular insert that is insertable into said diffusor block is adapted to receive the stock suspension from a distributor.

16. The stock inlet in accordance with claim 1, further comprising, at least one insert comprising a body located inside a respective tubular element;

said body having at least two blades and at least one magnet ring arranged to encompass said respective tubular element, wherein said at least one magnet ring acts on said at least two blade, thereby generating a turbulence.

17. The stock inlet in accordance with claim 16, wherein said at least one magnet ring comprises at least three magnet rings, and said at least magnet rings are arranged spaced from each other in a longitudinal direction of said respective tubular element.

18. The stock inlet in accordance with claim 16, wherein said body has between two and twelve external blades.

19. The stock inlet in accordance with claim 16, wherein said body includes external blades.

20. The stock inlet in accordance with claim 16, wherein said body includes an annular body having internal blades.

21. The stock inlet in accordance with claim 1, wherein said cross section of said suspension conduits increases in said flow direction in said second region.

22. The stock inlet in accordance with claim 1, wherein said cross section of said suspension conduits decreases in said second region.

23. The stock inlet in accordance with claim 1, wherein said cross section of said suspension conduits remains substantially the same in said second region.

24. The stock inlet in accordance with claim 1, wherein said second region directly follows said first region.

25. The stock inlet in accordance with claim 1, wherein a tapering of said dividing elements in said second region is formed by flat surfaces.

26. The stock inlet in accordance with claim 1, wherein a degree of one of divergence and convergence of all of said suspension conduits is of a substantially same magnitude.

27. The stock inlet in accordance with claim 1, wherein boundary surfaces of said suspension conduits, which extend across the width of the machine, form an angle between about 20° of convergence and about 120° of divergence.

28. The stock inlet in accordance with claim 1, wherein boundary surfaces of said suspension conduits, which extend across the width of the machine, form an angle between about 5° of convergence and about 7° of divergence.

29. The stock inlet in accordance with claim 1, wherein, with regard to surfaces in contact with the suspension in at least said second region, a course of at least one of said top wall and said bottom wall is formed as to a course of an adjacent surface of a neighboring dividing element.

30. The stock inlet in accordance with claim 1, wherein downstream ends of said dividing elements, relative to a stock flow direction, are arranged to form an arc.

31. The stock inlet in accordance with claim 30, wherein a radius center point M of said arc lies on a center line of a suspension jet produced.

32. The stock inlet in accordance with claim 30, wherein a radius center point M of said arc lies on angle bisectors of the suspension-contacted surfaces of said top wall and said bottom wall in said second region.

33. The stock inlet in accordance with claim 1, further comprising a turbulence generator having a plurality of diffuisor tubes, wherein said plurality of diffusor tubes are arranged in rows running across the width of the machine and said dividing elements beginning between said rows of said diffusor tubes.

34. The stock inlet in accordance with claim 1, wherein said top wall and bottom wall are equal in length.

35. The stock inlet in accordance with claim 1, wherein said second region has a length between 0 and about 4 dm.

36. The stock inlet in accordance with claim 35, wherein said second region has a length of between about 0.5 and 2 dm.

37. The stock inlet in accordance with claim 1, wherein said dividing element comprise three dividing elements arranged to form four suspension conduits.

38. The stock inlet in accordance with claim 1, wherein said dividing elements have a greatest and smallest thickness in a range from a maximum of about 5 cm to a minimum of about 0.5 mm.

39. The stock inlet in accordance with claim 38, wherein said greatest and smallest thickness range for said dividing elements is a maximum of about 1 cm to a minimum of about 3 mm.

40. The stock inlet in accordance with claim 1, wherein, at least in said second region, all of said suspension conduits are substantially congruent.

41. The stock inlet in accordance with claim 1, wherein angle bisectors of all of said suspension conduits in said second region intersect at a same intersection point A.

42. The stock inlet in accordance with claim 41, wherein said dividing elements have tapering ends oriented toward said stock inlet aperture, and angle bisectors of all of said tapering ends intersect at a same intersection point B.

43. The stock inlet in accordance with claim 42, wherein said same intersection points A and B coincide.

44. The stock inlet in accordance with claim 42, wherein said tapering ends are arranged to form an arc, and wherein said same intersection points A and B are collinearly arranged on a line with a radius center point M of said arc.

45. The stock inlet in accordance with claim 44, wherein said same intersection points A and B coincide with said radius center point M.

46. The stock inlet in accordance with claim 1, wherein at least one of said top wall and said bottom wall has a shutter which is adapted to influences a height of an outlet gap of said stock inlet aperture.

47. The stock inlet in accordance with claim 1, wherein said top wall and said bottom wall are different lengths.

48. The stock inlet in accordance with claim 47, wherein said bottom wall is longer than said top wall.

49. The stock inlet in accordance with claim 47, wherein a shutter is attached to a shorter one of said top wall and said bottom wall.

50. The stock inlet in accordance with claim 1, wherein said top wall and said bottom wall are longer than said dividing elements.

* * * * *